US007708495B1

(12) United States Patent
Antee

(10) Patent No.: US 7,708,495 B1
(45) Date of Patent: May 4, 2010

(54) LEVEE SYSTEM

(76) Inventor: Chris Antee, 207 Glenhill Dr., Houma, LA (US) 70363

( * ) Notice: Subject to any disclaimer, the term of this patent is extended or adjusted under 35 U.S.C. 154(b) by 0 days.

(21) Appl. No.: 12/273,826

(22) Filed: Nov. 19, 2008

Related U.S. Application Data

(60) Provisional application No. 60/989,162, filed on Nov. 20, 2007.

(51) Int. Cl.
*E02B 7/02* (2006.01)

(52) U.S. Cl. ..... 405/114; 405/111; 405/15

(58) Field of Classification Search ..... 405/114, 405/111, 107, 116, 15, 21, 25, 33, 34, 35, 405/30, 31
See application file for complete search history.

(56) References Cited

U.S. PATENT DOCUMENTS

| | | | | | |
|---|---|---|---|---|---|
| 274,449 | A | | 3/1883 | Lee | |
| 277,732 | A | | 5/1883 | Howell | |
| 390,175 | A | | 9/1888 | Lee | |
| 945,859 | A | | 1/1910 | Neuberger | |
| 1,002,161 | A | | 8/1911 | Lambert | |
| 1,230,608 | A | * | 6/1917 | Sheldon | 405/32 |
| 1,552,077 | A | | 9/1925 | Palanti | |
| 2,014,116 | A | * | 9/1935 | Powers | 405/23 |
| 2,466,343 | A | | 4/1949 | Weber | |
| 3,441,140 | A | | 4/1969 | Thurber | |
| 3,645,100 | A | | 2/1972 | La Monica | |
| 4,031,676 | A | * | 6/1977 | Dally | 405/114 |
| 4,073,245 | A | | 2/1978 | Anderson | |
| 4,129,006 | A | * | 12/1978 | Payne | 405/31 |
| 4,175,888 | A | | 11/1979 | Ijima | |
| 4,189,252 | A | | 2/1980 | Inman | |
| 4,192,628 | A | | 3/1980 | Gorman | |
| 4,341,050 | A | | 7/1982 | Long | |
| 4,345,856 | A | | 8/1982 | Tuck | |
| 4,431,337 | A | | 2/1984 | Iwasa | |
| 4,465,399 | A | | 8/1984 | Kikuzawa et al. | |
| 4,661,014 | A | | 4/1987 | Aubert | |
| 4,692,060 | A | * | 9/1987 | Jackson, III | 405/115 |
| 4,784,520 | A | * | 11/1988 | Stevens | 405/107 |
| 4,869,617 | A | * | 9/1989 | Chiodo | 405/114 |
| 4,869,620 | A | | 9/1989 | Dow | |
| 4,903,782 | A | | 2/1990 | McClellan | |
| 4,954,013 | A | | 9/1990 | Lamberton | |
| 5,017,042 | A | | 5/1991 | Minor et al. | |
| 5,118,222 | A | | 6/1992 | Dow | |
| 5,176,468 | A | * | 1/1993 | Poole | 405/111 |
| 5,403,125 | A | | 4/1995 | Andersen | |

(Continued)

FOREIGN PATENT DOCUMENTS

| | | |
|---|---|---|
| EP | 1 193 348 | 4/2002 |

(Continued)

*Primary Examiner*—Frederick L Lagman
(74) *Attorney, Agent, or Firm*—Garvey, Smith, Nehrbass & North, L.L.C.; Brett A. North

(57) ABSTRACT

A levee apparatus is constructed of base panels connected end to end and supported by an underlying support such as the earth's surface. Side panels interlock with the base panels and with each other to form a generally triangular transverse cross section and a hollow interior that can be filled with a selected fill material. Interlocking projections on the side panels interlock with apertures of the base and with notches or recesses of other side panels.

28 Claims, 10 Drawing Sheets

U.S. PATENT DOCUMENTS

| | | | | |
|---|---|---|---|---|
| 5,599,136 | A | 2/1997 | Wilke | |
| 5,899,632 | A * | 5/1999 | Martin | 405/21 |
| 5,971,661 | A | 10/1999 | Johnson et al. | |
| 6,012,872 | A | 1/2000 | Perry et al. | |
| 6,022,172 | A * | 2/2000 | Siyaj | 405/111 |
| 6,059,491 | A * | 5/2000 | Striefel et al. | 405/111 |
| 6,390,154 | B1 | 5/2002 | Hall | |
| 6,443,652 | B1 | 9/2002 | Houck et al. | |
| 6,485,230 | B2 | 11/2002 | Robinson | |
| 6,558,075 | B2 | 5/2003 | Benedict et al. | |
| 6,637,474 | B2 | 10/2003 | Hall | |
| 6,672,799 | B2 * | 1/2004 | Earl | 405/111 |
| 6,679,654 | B1 * | 1/2004 | Wittenberg et al. | 405/114 |
| 6,695,534 | B2 * | 2/2004 | Cain et al. | 405/114 |
| 7,214,004 | B2 * | 5/2007 | Javanbakhsh | 405/114 |
| 7,214,005 | B1 | 5/2007 | Davis | |
| 2002/0197112 | A1 | 12/2002 | Okazaki | |
| 2003/0118407 | A1 | 6/2003 | Gertz et al. | |
| 2003/0156903 | A1 | 8/2003 | Wiseman et al. | |
| 2004/0047688 | A1 | 3/2004 | Clement | |
| 2004/0131430 | A1 | 7/2004 | Boys | |
| 2004/0156680 | A1 | 8/2004 | Gibbs | |
| 2004/0234340 | A1 | 11/2004 | Cho et al. | |
| 2004/0261890 | A1 | 12/2004 | Sweningson | |
| 2005/0053429 | A1 | 3/2005 | Davidsaver et al. | |
| 2005/0158122 | A1 | 7/2005 | Lee | |
| 2005/0260038 | A1 | 11/2005 | Costa | |
| 2006/0000179 | A1 | 1/2006 | Albert | |
| 2006/0275081 | A1 | 12/2006 | Folgado et al. | |
| 2007/0009326 | A1 * | 1/2007 | Javanbakhsh | 405/114 |
| 2007/0077123 | A1 * | 4/2007 | Williams et al. | 405/107 |
| 2007/0116522 | A1 | 5/2007 | Boudreaux, Jr. | |
| 2007/0154264 | A1 | 7/2007 | Baruh | |
| 2007/0196178 | A1 | 8/2007 | Sweningson | |
| 2008/0155929 | A1 * | 7/2008 | Herron | 52/582.1 |

FOREIGN PATENT DOCUMENTS

| | | |
|---|---|---|
| EP | 1 148 376 | 5/2004 |
| EP | 1 508 643 | 2/2005 |
| ES | 2097789 | 4/1997 |
| JP | 56-77413 | 6/1981 |
| JP | 2112512 | 4/1990 |
| JP | 6041934 | 2/1994 |
| WO | WO99/03659 | 1/1999 |
| WO | WO99/11868 | 3/1999 |
| WO | WO 99/57376 | 11/1999 |
| WO | WO 02/068770 | 9/2002 |

* cited by examiner

LEVEE SYSTEM

CROSS-REFERENCE TO RELATED APPLICATIONS

Priority of U.S. Provisional Patent Application Ser. No. 60/989,162, filed Nov. 20, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to portable and/or quickly constructed levees. More particularly, the present invention relates to a levee apparatus that employs base panels and inclined panels that interlock to provide a generally triangular cross section with an interior that can be filled with a selected fill material (e.g. soil, sand, gravel, etc.), wherein alternating projections and sockets/apertures along edges of the panels interlock to form a connection of each panel to other of the panels.

2. General Background of the Invention

Levees are often constructed of earthen material. In some locations the side of an earthen levee is lined with concrete. The U.S. Army Corps of Engineers has for years constructed earthen levees with a portion of a side of the levee being covered with a layer of reinforced concrete. At the U.S. Army Corps of Engineers facility at Vicksburg, Miss., concrete levee mats have been fabricated for years.

Portable levee systems have been patented as noted in the following table of possibly related art.

The following U.S. Patents are incorporated herein by reference:

TABLE

| Pat. No. | TITLE | ISSUE DATE |
|---|---|---|
| 274,449 | Building Brick | Mar. 20, 1883 |
| 277,732 | Method of Constructing Levees and Embankments | May 15, 1883 |
| 390,175 | Hollow Building Block or Brick | Sep. 25, 1888 |
| 945,859 | Building Block | Jan. 11, 1910 |
| 1,002,161 | Sea Wall Construction | Aug. 29, 1911 |
| 1,552,077 | Block for Building Construction | Sep. 01, 1925 |
| 2,466,343 | Jetty | Apr. 05, 1949 |
| 3,441,140 | Drain Filter | Apr. 29, 1969 |
| 3,645,100 | Leaching Chamber Unit for Soil Absorption System | Feb. 29, 1972 |
| 4,073,245 | Levee Forming Apparatus and Method | Feb. 14, 1978 |
| 4,175,888 | Block for Constructing Breakwater | Nov. 27, 1979 |
| 4,189,252 | Undersea Platform Construction System | Feb. 19, 1980 |
| 4,192,628 | Flow Distributor for Leaching Fields | Mar. 11, 1980 |
| 4,341,050 | Construction Module | Jul. 27, 1982 |
| 4,345,856 | Composition and Process for Stabilizing Embankments | Aug. 24, 1982 |
| 4,431,337 | Wave Dissipation Caisson | Feb. 14, 1984 |
| 4,465,399 | Artificial Reef Assembly Construction and a Method | Aug. 14, 1984 |
| 4,661,014 | Prefabricated Civil Engineering Module, Method for the Construction of a Structure Including Said Module and Resulting Structure | Apr. 28, 1987 |
| 4,869,620 | Method and Apparatus for Constructing Seawalls and Docks | Sep. 26, 1989 |
| 4,903,782 | Levee Squeezer | Feb. 27, 1990 |
| 4,954,013 | Means and Method for Stabilizing Shorelines | Sep. 04, 1990 |
| 5,017,042 | Fluid Directing Systems | May 21, 1991 |
| 5,118,222 | Method and Apparatus for Constructing Seawalls and Docks | Jun. 02, 1992 |
| 5,403,125 | Method and Apparatus for Providing Underground Barrier | Apr. 04, 1995 |
| 5,599,136 | Structure for Topography Stabilization and Runoff Control | Feb. 04, 1997 |
| 5,971,661 | Water Containment Device and Levee for Impeding a Flow of Water | Oct. 26, 1999 |
| 6,012,872 | Flood Control System | Jan. 11, 2000 |
| 6,390,154 | Portable Levee System and Portable Levee System Bag | May 21, 2002 |
| 6,443,652 | Aggregate Chamber Leach Lines for Leaching Effluent and Associated Method | Sep. 03, 2002 |
| 6,485,230 | Submersible Modular Dike and Method for Segregating Body of Water | Nov. 26, 2002 |
| 2002/0197112 | Structure and Method for Detecting an Inflated State of a Flexible Membrane Dam | Dec. 26, 2002 |
| 6,558,075 | Permanent and Semi-Permanent Groyne Structures and Method for Shoreline and Land Mass Reclamation | May 06, 2003 |
| 2003/0118407 | Transportable Dam and a Method of Erecting the Same | Jun. 26, 2003 |
| 2003/0156903 | Frame Members for a Portable Dam | Aug. 21, 2003 |
| 6,637,474 | Portable Levee System | Oct. 28, 2003 |
| 2004/0047688 | Liquid Containment/Diversion Dike | Mar. 11, 2004 |
| 2004/0131430 | Retaining Wall Block and Drainage System | Jul. 08, 2004 |
| 2004/0156680 | Beach Stabilizing Blocks | Aug. 12, 2004 |
| 2004/0234340 | Mobile Levee System | Nov. 25, 2004 |
| 2004/0261890 | Portable Levee System | Dec. 30, 2004 |
| 2005/0053429 | Modular Retaining Wall | Mar. 10, 2005 |
| 2005/0158122 | Method for Constructing Check Dam or Fire Prevention Dam Using Gear-Type Block | Jul. 21, 2005 |
| 2005/0260038 | Hydraulic Dam | Nov. 24, 2005 |
| 2006/0000179 | Building Block | Jan. 05, 2006 |
| 2006/0275081 | Modular Dike for Shore Protection | Dec. 07, 2006 |
| 7,214,005 | Sectionalized Flood Control Barrier | May 08, 2007 |
| 2007/0116522 | Flood Levee and Barrier Module and System | May 24, 2007 |
| 2007/0154264 | Portable Dike and Floatation Device | Jul. 05, 2007 |
| 2007/0196178 | Portable Levee System | Aug. 23, 2007 |
| JP56-77413 | Dam | Jun. 25, 1981 |
| JP2112512 | Wave Dissipation Submerged Dike | Apr. 25, 1990 |
| JP6041934 | Submerged Breakwater | Feb. 15, 1994 |
| ES2097789 | Breakwater | Apr. 16, 1997 |
| WO99/03659 | Concrete Block, Joint for the Same, and Structure of Concrete Blocks | Jan. 28, 1999 |
| WO99/11868 | Dike Module | Mar. 11, 1999 |
| WO99/57376 | A Technique and a Device for Building Protective Sea Walls or Artificial Reefs Made of Modular Parts | Nov. 11, 1999 |
| EP1,193,348 | Modular Elements to be Cast and Fixed in Seabeds or the Like for the Re-formation of Aquatic Life | Apr. 03, 2002 |
| WO02/068770 | Fluent Material Confinement System | Sep. 06, 2002 |
| EP1,418,376 | Method and Structure for Connecting Difficult− TO− Join Pipes to be Used at High Temperature | May 12, 2004 |
| EP1,508,643 | Flood Barrier | Feb. 23, 2005 |

BRIEF SUMMARY OF THE INVENTION

The present invention provides an improved levee apparatus that employs multiple interlocking panels to form an elongated hollow structure with an interior that accepts a selected fill material such as sand, gravel, soil or the like.

In various embodiments reinforcement is provided in the interlocking panels, such as re-bar and/or wire mesh. In one embodiment reinforcement can be used to lock one or more of the interlocking panels.

In one embodiment one or more of the panels can comprise concrete.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 3, 4:
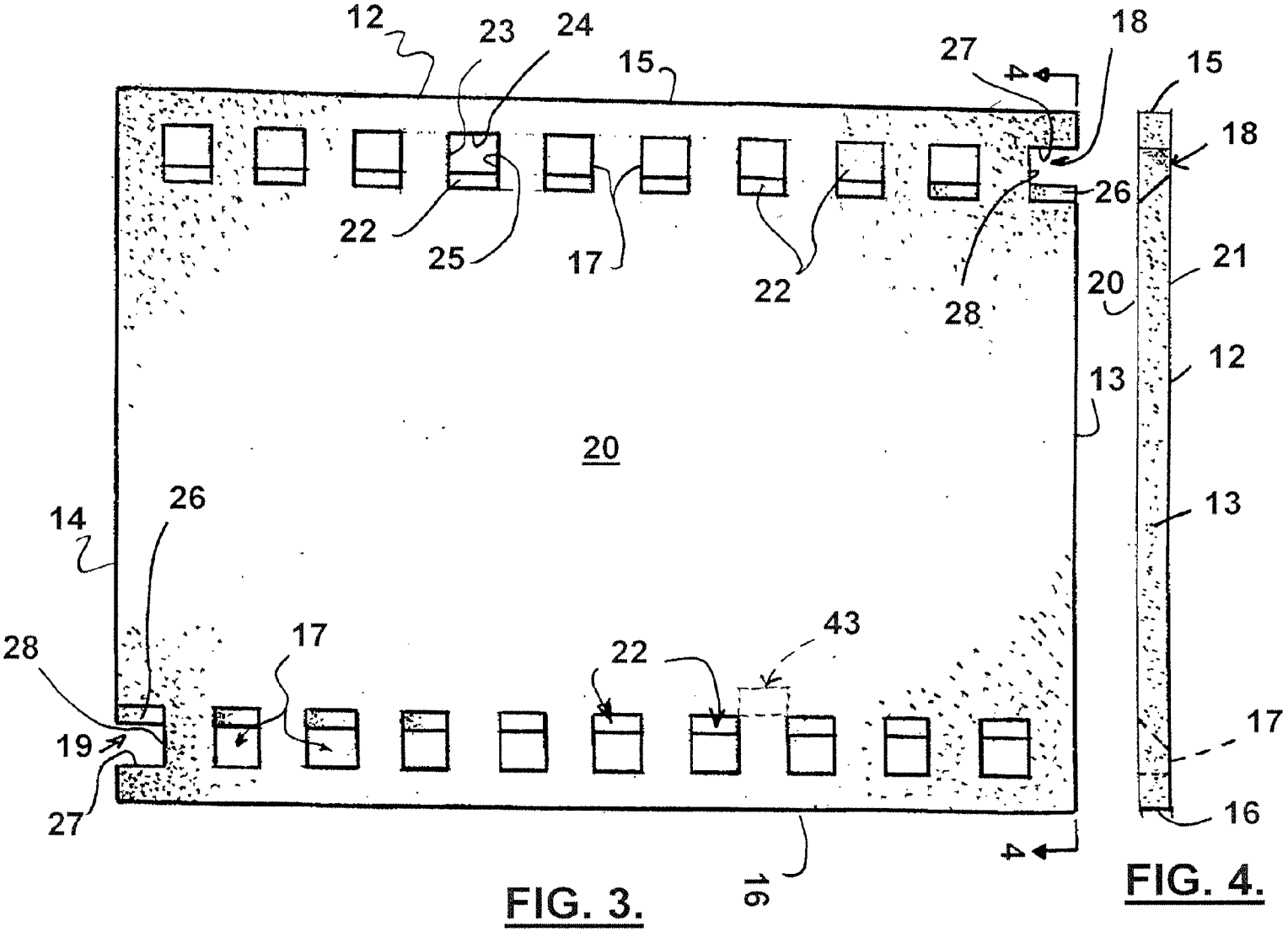
FIG. 3 is a plan view of one of the base panel portions of the preferred embodiment of the apparatus of the present invention.
FIG. 4 is an end view taken along lines 4-4 of FIG. 3.
Figure 5:
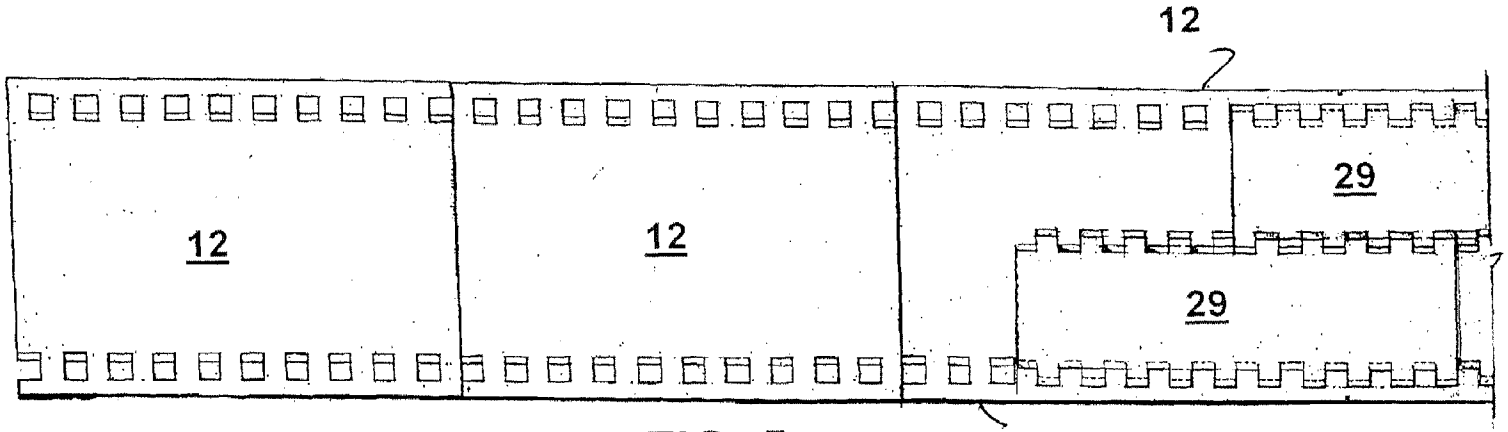
FIG. 5 is a plan view of the preferred embodiment of the apparatus of the present invention.
Figure 13:
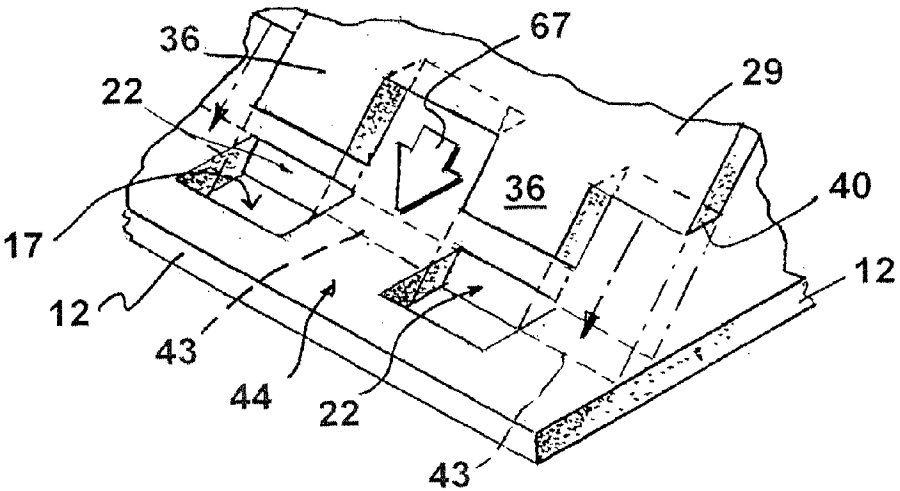
FIG. 13 is a perspective fragmentary view of the preferred embodiment of the apparatus of the present invention.
Figure 6:
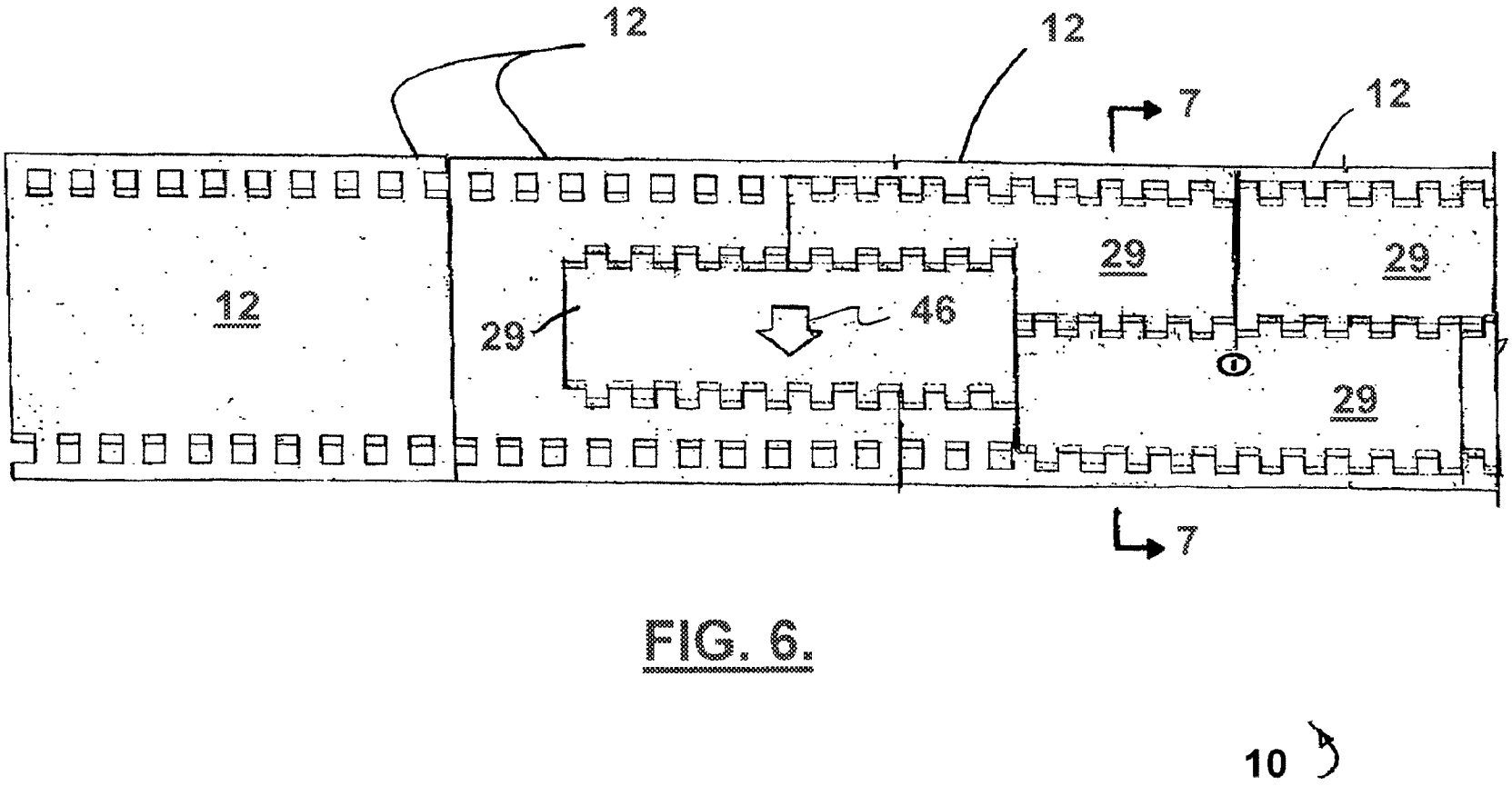
FIG. 6 is a plan view of the preferred embodiment of the apparatus of the present invention illustrating installation of one of the inclined side panels upon the base panels.
Figure 7:
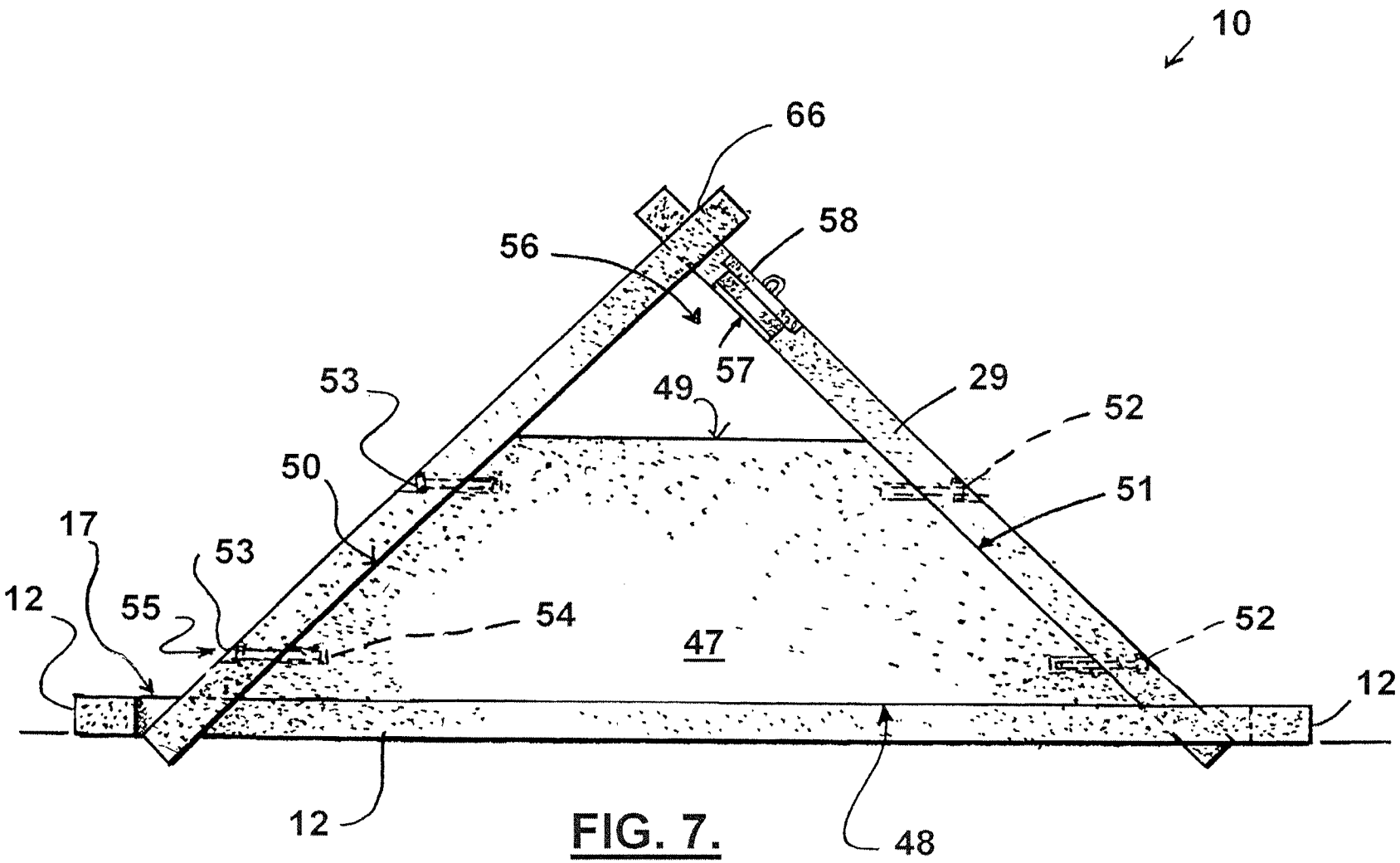
FIG. 7 is a sectional view taken along lines 7-7 of FIG. 6.
Figure 8:
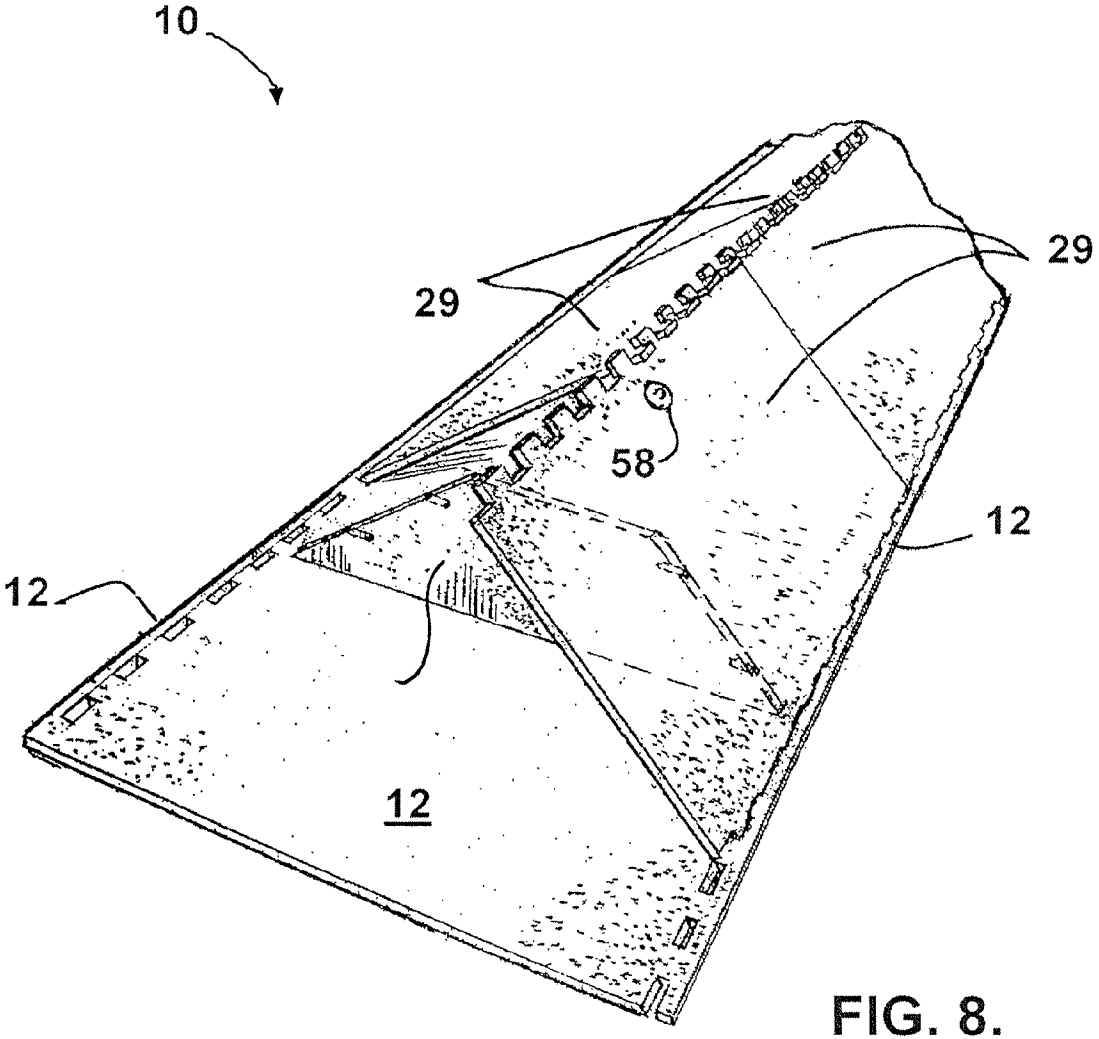
FIG. 8 is a perspective view of the preferred embodiment of the apparatus of the present invention.

FIGS. 1-8 and 13 show the preferred embodiment of the apparatus of the present invention, designated generally by the numeral 10 in FIGS. 6-8. Levee apparatus 10 provides a base panel 12 that interlocks with a pair of inclined side panels 29. Base panels 12 are place end-to-end. Side panels 29 are then connected to the base panels 12. Side panels 29 are connected to each other at apex 66. The panel 12 and the inclined side panels 29 are connected in a staggered, brick lay type pattern as shown in FIGS. 5-8 and 13. Once connected together, the panels 12, 13 form a generally triangular cross section (see FIG. 7).

Figures 1, 2:
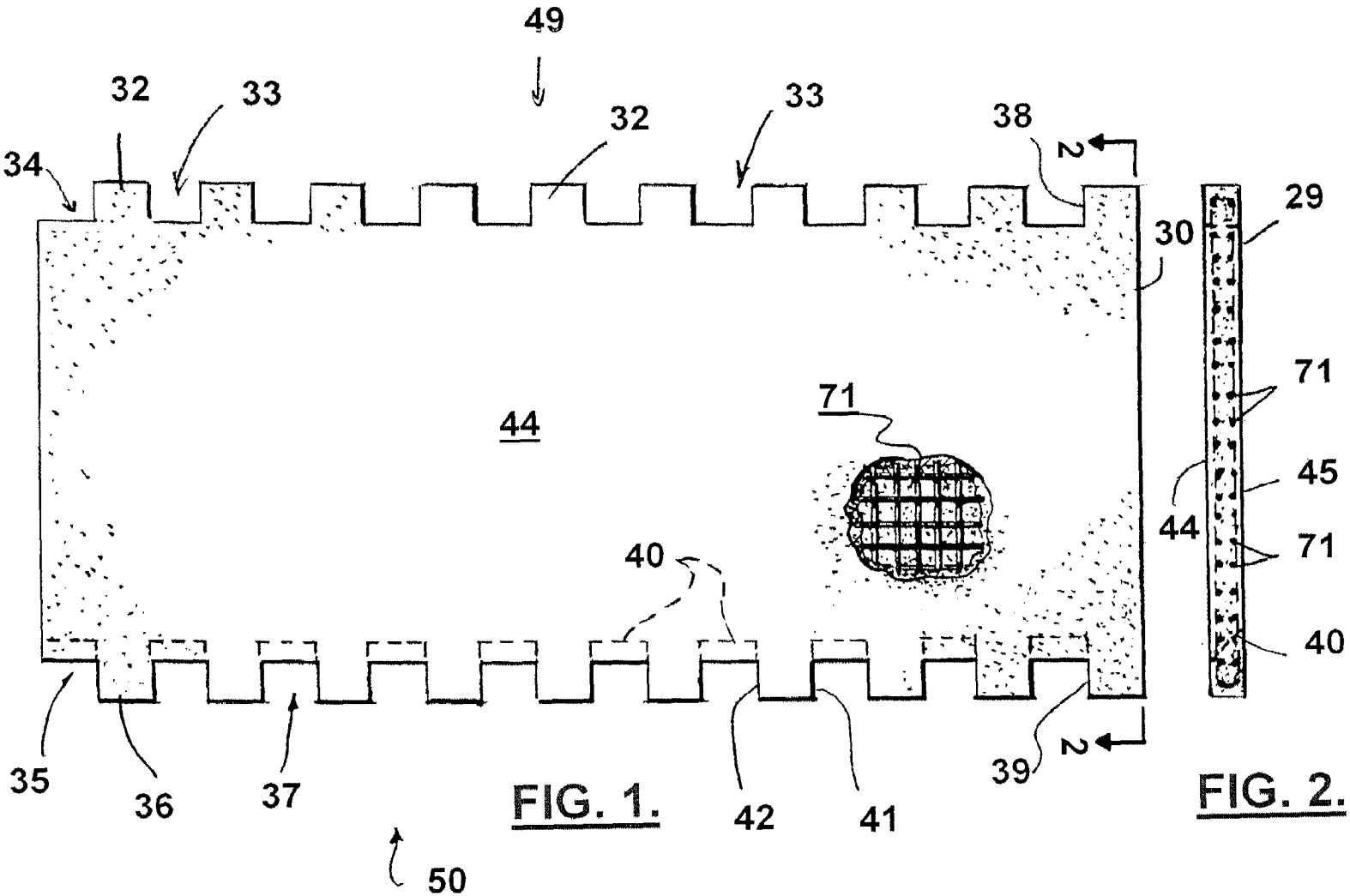
FIG. 1 is a plan view of one of the side panel portions of the preferred embodiment of the apparatus of the present invention.
FIG. 2 is an end view taken along lines 2-2 of FIG. 1.

In FIGS. 1-2, a side panel 29 is shown in more detail. Side panel 29 has end edges 30, 31, upper surface 44, lower surface 45, upper edge 49 and lower edge 50. Side panel 29 has projections 32 that are spaced apart along upper edge 49. A gap 33 is placed between each pair of projections 32.

At end edge 31, there is a notch 34 near upper edge 49 and a notch 35 next to lower edge 50. Similarly, there are projections 36 and gaps 37 along lower edge 50. A beveled or inclined surface 40 is provided next to each gap 37. These surfaces 40 are bearing surfaces that bear against contact area 43 on the upper surface 20 of base panel 12. Surfaces 40, 41, 42 surround each gap 37. Each gap 33 can be generally rectangular in shape, surrounded by three surfaces that are normal to both the upper 44 and the lower 45 surfaces of side panel 29. Projections 38, 39 are next to end edge 30. Each projection 38, 39 can share an edge with end edge 30 as shown in FIG. 1.

Base panel 12 is shown in more detail in FIGS. 3 and 4. Base panel 12 has end edges 13, 14 and side edges 15, 16. A plurality of apertures 17 are provided along each edge 15, 16 as shown in FIGS. 3-4. Each aperture 17 extends through panel 12, communicating with upper surface 20 and lower surface 21 as shown in FIGS. 3-4.

Notches 18, 19 are provided on panel 12. Notch 18 is positioned next to the side edge 15 and communicating with the end edge 13. Notch 19 is positioned next to the side edge 16 and communicating with the end edge 14.

Each aperture 17 is bordered by a beveled or inclined surface 22 that forms an acute angle with panel 12 lower surface 21 as shown in FIGS. 3-4. Each aperture 17 is also surrounded by or bordered by surfaces 23, 24, 25 that are surfaces preferably normal to surfaces 20, 21. Each notch 18, 19 is surrounded by or bordered by surfaces 26 (beveled or inclined), 27, 28. A contact or load transfer area 43 on base panel 12 is engaged and contacted by a diagonally extending or beveled surface 40 of a side panel 29 as shown in FIGS. 1-5 and 13. Each base panel 12 and side panel 29 can be reinforced with reinforcing steel 71 or any other suitable reinforcement.

To erect levee apparatus 10, base panels 12 are placed end-to-end as shown in FIGS. 5 and 6. The end edge 13 of one base panel 12 is place next to and aligned with the end edge 14 of another base panel 12. Side panels 29 can be attached to base panels 12 in an alternating, brick layered type pattern of FIGS. 5-6 and 13 (see arrows 46, 67). Each side panel 29 thus preferably attaches to a pair of base panels 12 as well as to a pair of side panels 29 at apex 66 (see FIG. 7).

Bolted connections 52 can be used to affix each pair of side panels to support 47 as shown in FIG. 7. Each bolted connection 52 can employ a bolt or fastener 53 that engages an internally threaded opening 54 in support panel 47. An opening 55 is a bolt opening that enables each fastener to pass through a panel 29.

An air space 56 is provided below the erected side panels 29 as shown in FIG. 7. Fill opening 57 enables a selected fill material 59 (e.g. sand, soil, gravel) that is suitable for the construction of levees to be added to space 56. Cap or cover 58 seals or covers fill opening 57 before and after filling space 56 with fill material 59.

Figure 9:
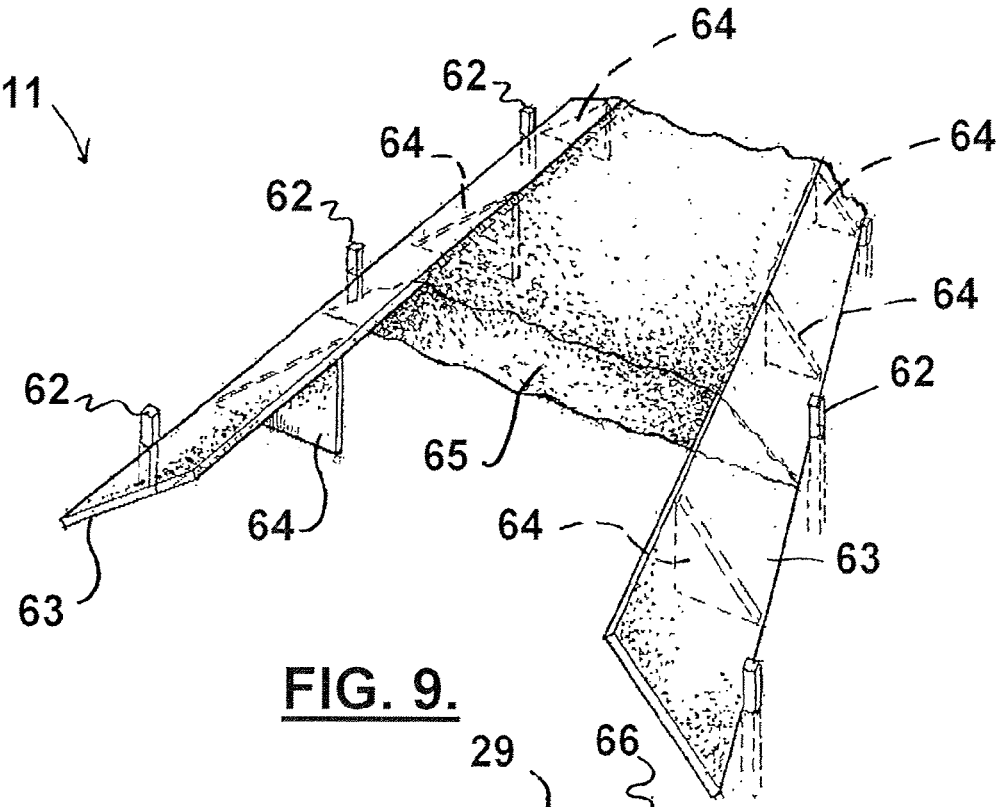
FIG. 9 is a partial perspective view of a second embodiment of the apparatus of the present invention.
Figure 10:
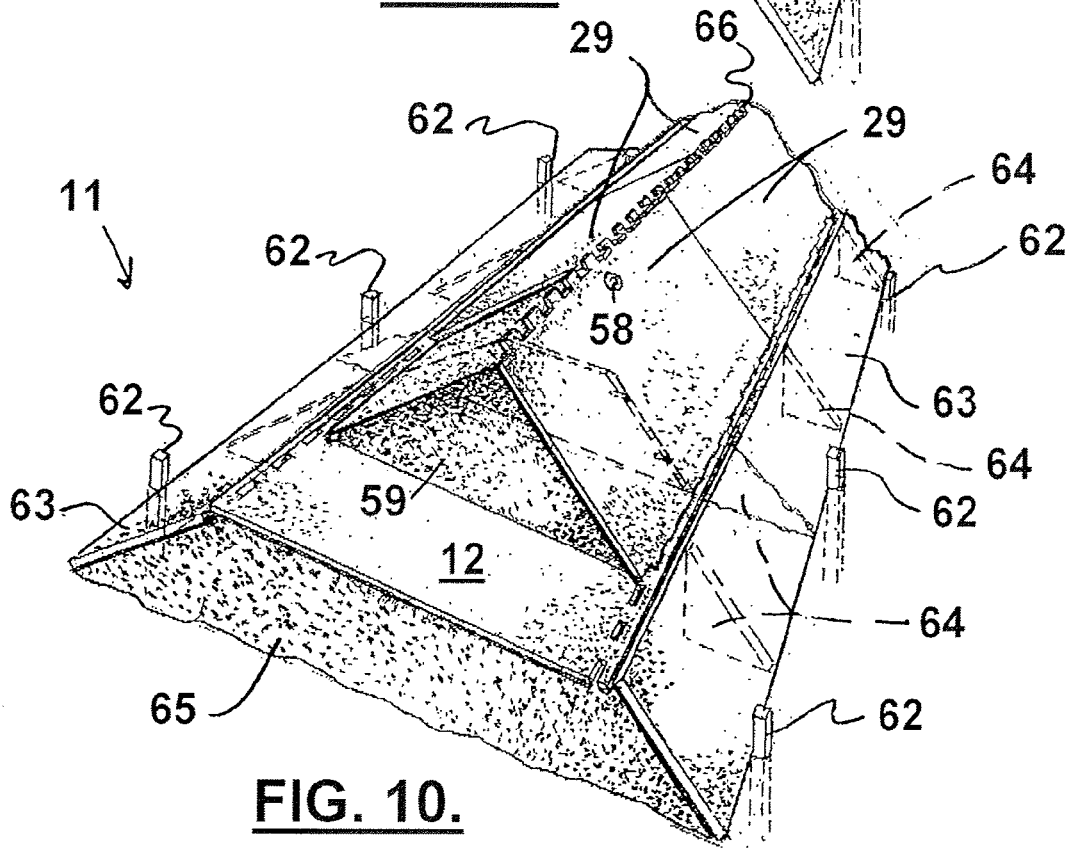
FIG. 10 is a sectional view of the second embodiment of the apparatus of the present invention.
Figure 11:
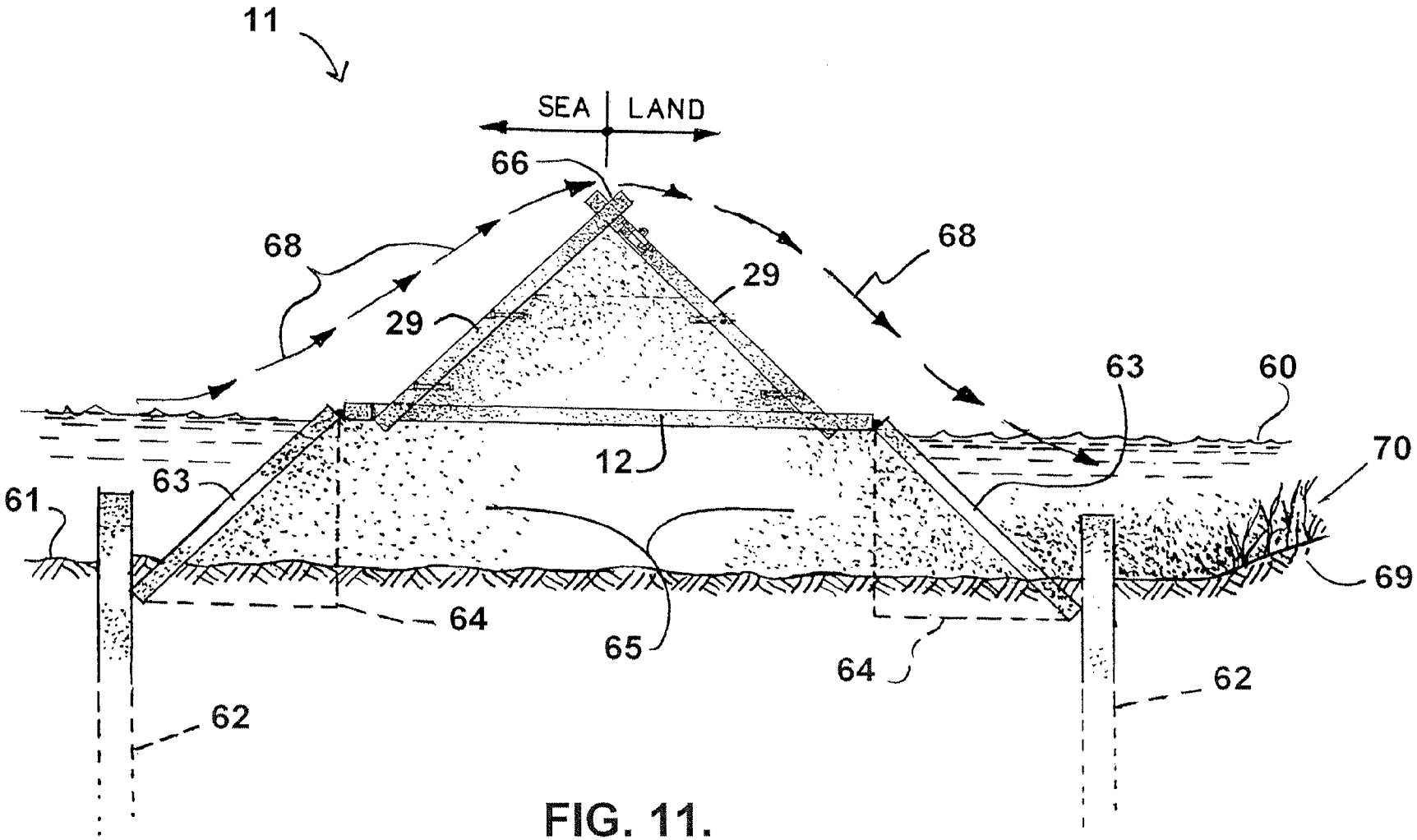
FIG. 11 is a sectional view of the second embodiment of the apparatus of the present invention.

FIGS. 9-11 show an alternate levee apparatus 11 that uses a plurality of inclined panels 63 secured to a water bed 61 that is under a water body 60. Piling 62, triangular panels 63 and fill material 65 hold panels 63 in an inclined position. In various embodiments the angle of inclination can be about 5, 10, 15, 20, 25, 30, 35, 40, 45, 50, 55, 60, 65, 70, 75, 80, 85, 89, and 90 degrees with the water bed 61. In various embodiments the angle of inclination can be in a range of between about any two of the above referenced angles.

Once piling 62, panels 63, 64 and fill material 65 have been erected, levee apparatus 10 (FIGS. 1-8 and 12-13) can be erected upon fill material 65 as shown in FIG. 11.

Arrows 68 in FIG. 11 show water flow over levee 11 during a storm surge. Water flows over levee 11 carrying accretions 69 that accumulate to form a new land mass that supports plant life 70 for replenishment of wetlands that have eroded.

Figure 12:
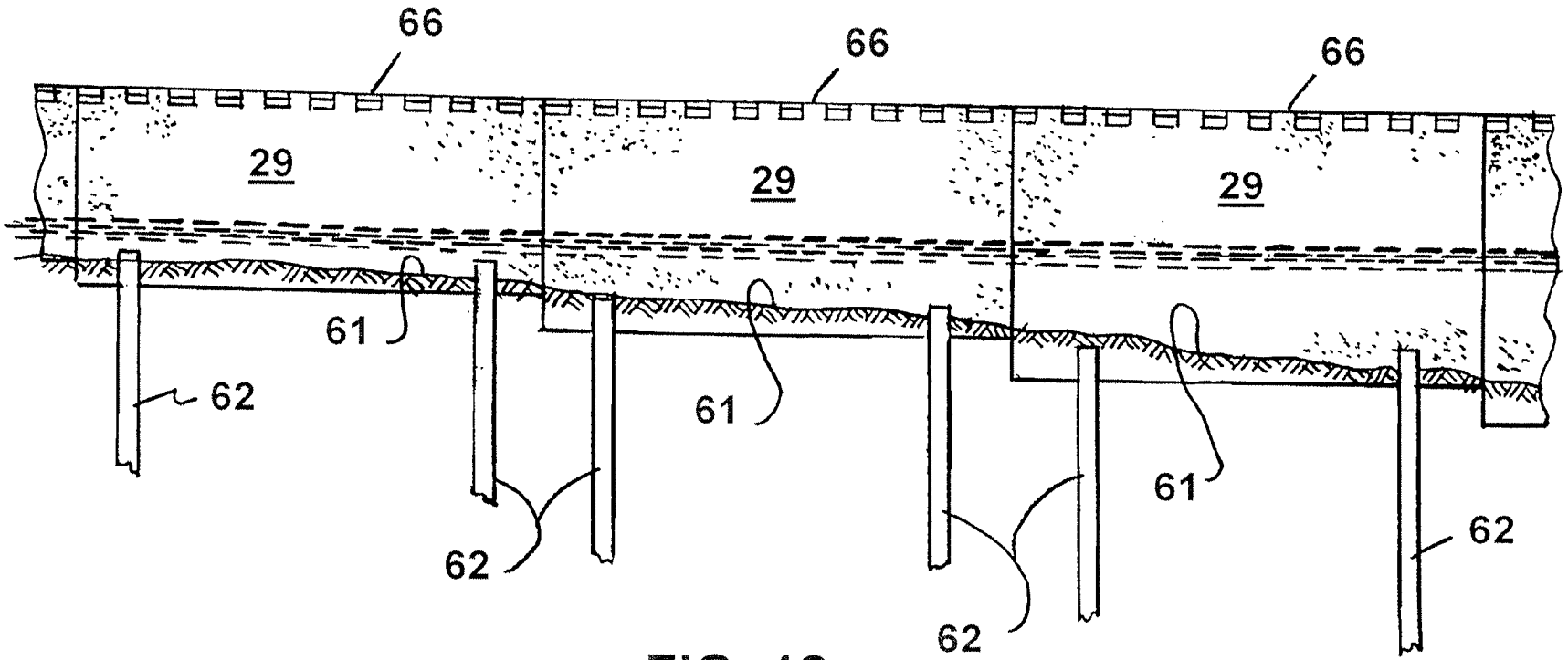
FIG. 12 is a side view of the preferred embodiment of the apparatus of the present invention, showing use of the side panels without the base panels.

FIG. 12 illustrates that side panels 29 can be erected and interlocked at apex 77 and held in position using piling 62 rather than base panel 12. In FIG. 12, the side panels 29 would be interlocked and brick layed staggered fashion as with the embodiment of FIGS. 1-11. However, pilings 62 support two panels 29 in an inclined position forming a generally triangularly shaped levee which can be back filled with a selected fill material such as sand, gravel, soil, or the like. In FIG. 12, notice that the side panels 29 can be of differing sizes to accommodate changes in elevation of water bottom 61.

Figure 14:
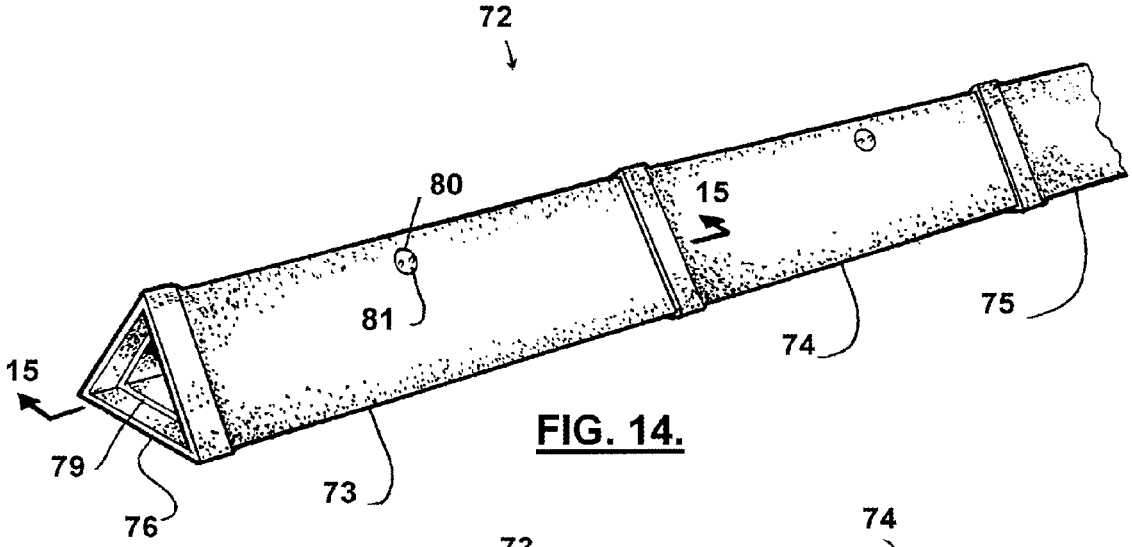
FIG. 14 is a perspective view of an additional embodiment of the apparatus of the present invention.
Figure 15:
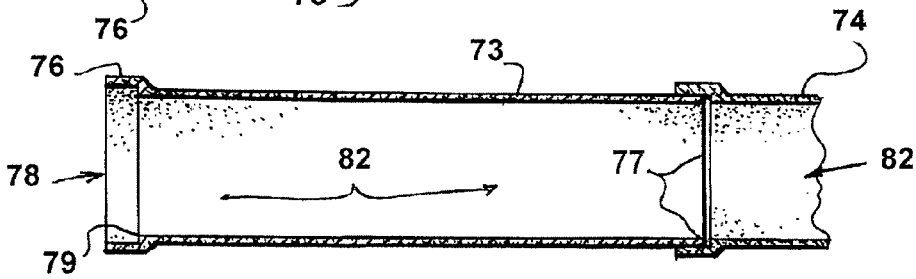
FIG. 15 is a sectional view taken along lines 15-15 of FIG. 14.

FIGS. 14 and 15 show an additional alternate embodiment of the apparatus of the present invention designated generally by the numeral 72. Levee apparatus 72 is comprised of a plurality of sections 73, 74, 75 and possibly additional sections that are connected end to end as shown in FIG. 14. Each section provides a first end portion 76 that interlocks with a second end portion 77. The end portion 76 provides a socket 78 that is receptive of an end portion 77 of another section as shown in FIG. 15. A stop 79 limits the amount of penetration of end portion 76 into socket 78 as shown in FIG. 15.

Each section 73, 74, 75 can provide an opening 80 that can be closed using a cap 81. Opening 80 and cap 81 enable fill material such as sand, gravel, soil, or other suitable fill material to be added to the interior 82 of each section 73, 74, 75. The levee apparatus 72 shown in FIGS. 14 and 15 could be employed in situations such as those shown and described with respect to FIGS. 1-13.

As an alternative to the sections 73, 74, 75 shown in FIGS. 14 and 15, similarly connecting interlocking sections could be provided wherein each section has a gradual taper along its length. An end portion of each section is of a slightly larger, generally triangular cross section. The other end portion of that section is of a smaller, generally triangular cross section. In such a case, an end portion of one such tapered section fits into the end portion of another such tapered section. In this embodiment a section can be pulled longitudinally from a mold for forming the panel. Alternatively, the mold can be made in interlocking sections which lock when section is poured and cured, and unlock after section has cured.

In one alternative embodiment can be included a variation of the embodiment shown in FIGS. 9 through 11. In this embodiment the upper portion of the levee barrier (panels 29) does not span from edge to edge of the lower portion of the barrier (panels 63)—as shown in FIGS. 10 and 11. Instead, a smaller portion (with spaced apart edges) compared to the larger lower portion is used. In various embodiments the upper portion can span about 5, 10, 15, 20, 25, 30, 35, 40, 45, 50, 55, 60, 65, 70, 75, 80, 85, 90, and 95 percent of the width of the upper part of the lower portion. In various embodiments the spanning percentage can be in a range of between about any two of the above referenced percentages.

The following is a list of parts and materials suitable for use in the present invention.

PARTS LIST

| Part Number | Description |
|---|---|
| 10 | levee apparatus |
| 11 | levee apparatus |
| 12 | base panel |

-continued

PARTS LIST

| Part Number | Description |
|---|---|
| 13 | end edge |
| 14 | end edge |
| 15 | side edge |
| 16 | side edge |
| 17 | aperture |
| 18 | notch |
| 19 | notch |
| 20 | upper surface |
| 21 | lower surface |
| 22 | diagonally extending surface |
| 23 | surface |
| 24 | surface |
| 25 | surface |
| 26 | diagonally extending surface |
| 27 | surface |
| 28 | surface |
| 29 | inclined side panel |
| 30 | end edge |
| 31 | end edge |
| 32 | projection |
| 33 | gap |
| 34 | notch |
| 35 | notch |
| 36 | projection |
| 37 | gap |
| 38 | projection |
| 39 | projection |
| 40 | diagonally extending surface |
| 41 | surface |
| 42 | surface |
| 43 | contact area |
| 44 | upper surface |
| 45 | lower surface |
| 46 | arrow |
| 47 | support |
| 48 | lower surface |
| 49 | arrow |
| 50 | upper edge |
| 51 | lower edge |
| 52 | bolted connection |
| 53 | fastener |
| 54 | internally threaded opening |
| 55 | bolt opening |
| 56 | air space |
| 57 | fill opening |
| 58 | cap |
| 59 | fill material |
| 60 | water body |
| 61 | waterbed |
| 62 | piling |
| 63 | inclined panel |
| 64 | triangular panel |
| 65 | fill |
| 66 | apex |
| 67 | arrow |
| 68 | arrow |
| 69 | accretions |
| 70 | plant life |
| 71 | reinforcing steel |
| 72 | levee apparatus |
| 73 | section |
| 74 | section |
| 75 | section |
| 76 | first end portion |
| 77 | second end portion |
| 78 | socket |
| 79 | stop |
| 80 | opening |
| 81 | cap |
| 82 | interior |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A levee apparatus, comprising:

a) a plurality of panels connected together to form an elongated levee having a generally triangularly shaped transverse cross section and a hollow interior;

b) the panels including a plurality of base panels having upper and lower surface, opposed edges and opposed ends, each base panel having a plurality of spaced apart apertures along each edge and extending between the upper and lower surfaces;

c) the panels including a plurality of side wall panels that each have opposed edges and opposed ends, each edge having a plurality of alternating projections and sockets;

d) each side wall panel connecting to a base panel and a side wall panel by interlocking connections;

e) said connections including an engagement of the projections of a side wall panel with the apertures of the base panel at a lower connection and an engagement of the projections of a side wall panel with the sockets of another side wall panel at an upper connection;

f) wherein the side wall panels are inclined, forming an acute angle with the base panel; and g) wherein at least some apertures of a base panel are surrounded by at least one surface that forms an acute angle with the lower surface of that base panel.

2. The levee apparatus of claim 1 wherein at least one side panel connects to more than one base panel.

3. The levee apparatus of claim 1 wherein at least one side panel connects to more than one side wall panel.

4. The levee apparatus of claim 1 wherein at least one side panel connects to more than one side wall panel and to more than one base panel.

5. The levee apparatus of claim 1 wherein at least some apertures of a base panel are surrounded by at least one surface that forms an acute angle with the lower surface of that base panel.

6. The levee apparatus of claim 1 wherein at least one of said panels is a reinforced concrete panel.

7. The levee apparatus of claim 1 further comprising at least one transverse panel that rests upon a base panel and that is attached to a pair of side panels.

8. The levee apparatus of claim 1 further comprising a plurality of spaced apart transverse panels, each transverse panel resting upon a base panel and being attached to a pair of side panels.

9. The levee apparatus of claim 1 further comprising a foundation placed under the base panels, said foundation including a first elongated row of a plurality of inclined foundation panels and a second elongated row of inclined foundation panels and a soil mass placed in between said rows of inclined panels.

10. The levee apparatus of claim 9 wherein each foundation panel forms an obtuse angle with a base panel.

11. A levee apparatus, comprising:

a) a plurality of panels connected together to form an elongated levee having a hollow interior;

b) the panels including a plurality of base panels having upper and lower surface, opposed edges and opposed ends, each base panel having a plurality of spaced apart sockets along each edge;

c) the panels including a plurality of side wall panels that each have opposed edges and opposed ends, each edge having a plurality of alternating projections and a recesses, a recess between each pair of projections;

d) each side wall panel connecting to a base panel and a side wall panel by interlocking connections;

e) said connections including an engagement of the projections of a side wall panel with the sockets of the base panel at a lower connection and an engagement of the projections of a side wall panel with the recesses of another side wall panel at an upper connection; and f) wherein at least one side wall panel being inclined, forming an acute angle with a base panel; and g) wherein at least some sockets of a base panel are surrounded by at least one surface that forms an acute angle with the lower surface of that base panel.

12. The levee apparatus of claim 11 wherein at least one side panel connects to more than one base panel.

13. The levee apparatus of claim 11 wherein at least one side panel connects to more than one side wall panel.

14. The levee apparatus of claim 11 wherein at least one side panel connects to more than one side wall panel and to more than one base panel.

15. The levee apparatus of claim 11 wherein at least some apertures of a base panel are surrounded by at least one surface that forms a generally right angle with the lower surface of that base panel.

16. The levee apparatus of claim 11 wherein at least one of said panels is a reinforced concrete panel.

17. The levee apparatus of claim 11 further comprising at least one transverse panel that rests upon a base panel and that is attached to a pair of side panels.

18. The levee apparatus of claim 11 further comprising a foundation placed under the base panels, said foundation including a first elongated row of a plurality of inclined foundation panels and a second elongated row of inclined foundation panels and a soil mass placed in between said rows of inclined panels.

19. The levee apparatus of claim 18 wherein each foundation panel forms an obtuse angle with a base panel.

20. A levee apparatus, comprising:

a) a plurality of sections connected together to form an elongated levee having a generally triangularly shaped transverse cross section and a hollow interior;

b) the sections including base panels and side wall panels;

c) each section connecting another section end-to-end;

d) said connections including a socket of one section and a projection of another section;

e) wherein the side wall panels are inclined, forming an acute angle with the base panel; and f) wherein the plurality of sections are held in position by a plurality of pilings.

21. The levee apparatus of claim 20 wherein each section has a bell shaped socket.

22. The levee apparatus of claim 20 wherein each section is tapered longitudinally.

23. The levee apparatus of claim 20 wherein the sections are hollow.

24. The levee apparatus of claim 20 wherein the end of one section overlaps the end of another section.

25. The levee apparatus of claim 24 wherein a stop limits the amount of overlap.

26. The levee apparatus of claim 20 wherein at least one of said sections is a reinforced concrete panel.

27. The levee apparatus of claim 20 further comprising at least one transverse section that defines a stop to limit the engagement of each projection and socket.

28. The levee apparatus of claim 23 wherein each section has an aperture for enabling fill material to be added to the interior.

* * * * *